US012378768B2

(12) United States Patent
Zheng et al.

(10) Patent No.: US 12,378,768 B2
(45) Date of Patent: Aug. 5, 2025

(54) MATRIX ASSISTED TWO COMPONENT ROOF COATING SYSTEM AND METHOD

(71) Applicant: BMIC LLC, Dallas, TX (US)

(72) Inventors: Yan Zheng, Livingston, NJ (US); Yixi Xiao, Edison, NJ (US); Daniel E. Boss, Morris Township, NJ (US); Adem Chich, Kearny, NJ (US)

(73) Assignee: BMIC LLC, Dallas, TX (US)

( * ) Notice: Subject to any disclaimer, the term of this patent is extended or adjusted under 35 U.S.C. 154(b) by 822 days.

(21) Appl. No.: 17/177,328

(22) Filed: Feb. 17, 2021

(65) Prior Publication Data

US 2021/0254343 A1 Aug. 19, 2021

Related U.S. Application Data

(60) Provisional application No. 62/978,032, filed on Feb. 18, 2020.

(51) Int. Cl.

| | |
|---|---|
| ***B05D 5/00*** | (2006.01) |
| ***D06N 3/18*** | (2006.01) |
| ***D06N 5/00*** | (2006.01) |
| ***E04D 11/02*** | (2006.01) |

(52) U.S. Cl.

CPC ..... *E04D 11/02* (2013.01); *D06N 3/183* (2013.01); *D06N 5/00* (2013.01); *D06N 2211/06* (2013.01)

(58) Field of Classification Search

CPC ..... B05D 5/00

See application file for complete search history.

(56) References Cited

U.S. PATENT DOCUMENTS

| | | | |
|---|---|---|---|
| 4,643,080 | A | 2/1987 | Trostle et al. |
| 4,668,315 | A | 5/1987 | Brady et al. |
| 4,909,135 | A | 3/1990 | Greko |
| 5,075,166 | A | 12/1991 | Siskorski et al. |
| 5,693,133 | A | 12/1997 | Largent et al. |

(Continued)

FOREIGN PATENT DOCUMENTS

| | | | |
|---|---|---|---|
| CA | 2530192 | C | 2/2012 |
| EP | 0420540 | A1 | 4/1991 |

(Continued)

OTHER PUBLICATIONS

Eric Garcia (NPL: Does Spray Foam Insulation Absorb Water? ([Datasheet [online]. [retrieved on Jul. 15, 2020]. Retrieved from the Internet: <URL: https://www.retrofoamofmichigan.com/blog/does-spray-foam-insulation-absorb-water#:~:text=Does%20spray%20foam%20absorb%20water,means%20it%20will%20dry%20out.>, (Year: 2020).*

(Continued)

*Primary Examiner* — Hai Y Zhang

(74) *Attorney, Agent, or Firm* — GREENBERG TRAURIG, LLP

(57) ABSTRACT

A two component roof coating system and method includes a sufficiently porous fabric attachable to a roof deck. A first component of the two component roof coating may be applied to the fabric after it is attached to the roof. Alternatively, fabric may be pre-soaked with the first component prior to attachment. A second component of the two component roof coating may then be applied to the fabric. The first and second components react with each other to form a waterproof roof coating. The fabric can hold the components in place and prevent sagging.

9 Claims, 2 Drawing Sheets

(56) References Cited

U.S. PATENT DOCUMENTS

| | | | |
|---|---|---|---|
| 7,024,829 | B2 | 4/2006 | Sharp et al. |
| 7,272,915 | B2 | 9/2007 | Peng |
| 7,285,183 | B2 | 10/2007 | Kajander et al. |
| 7,765,763 | B2 | 8/2010 | Teng et al. |
| 8,079,184 | B2 | 12/2011 | Wiercinski et al. |
| 8,309,211 | B2 | 11/2012 | Mehta et al. |
| 8,863,442 | B2 | 10/2014 | Freeman |
| 9,334,655 | B2 | 5/2016 | Polumbus et al. |
| 9,540,509 | B2 | 1/2017 | Kummer-Dorner et al. |
| 9,945,124 | B2 | 4/2018 | Baker |
| 9,963,880 | B2 | 5/2018 | Kraus et al. |
| 10,400,076 | B2 | 9/2019 | Ueno et al. |
| 2003/0159379 | A1 | 8/2003 | Pickler |
| 2006/0193995 | A1 | 8/2006 | Yong |
| 2008/0008858 | A1 | 1/2008 | Hong et al. |
| 2008/0289289 | A1* | 11/2008 | Wiercinski ..... B32B 27/12 52/745.06 |
| 2009/0013620 | A1 | 1/2009 | West |
| 2011/0223410 | A1 | 9/2011 | Gencer et al. |
| 2011/0252740 | A1 | 10/2011 | Hamlin, III |
| 2012/0077906 | A1 | 3/2012 | Herold et al. |
| 2012/0157597 | A1 | 6/2012 | Knight et al. |
| 2013/0034721 | A1 | 2/2013 | Wang et al. |
| 2014/0215963 | A1 | 8/2014 | Bradenburg et al. |
| 2014/0259972 | A1 | 9/2014 | Feuer et al. |
| 2015/0144250 | A1 | 5/2015 | Subotic et al. |
| 2015/0240495 | A1 | 8/2015 | Vermilion et al. |
| 2015/0361299 | A1 | 12/2015 | Byrne et al. |
| 2017/0145697 | A1 | 5/2017 | Anthony |
| 2018/0038046 | A1 | 2/2018 | Stachnik et al. |
| 2018/0327624 | A1* | 11/2018 | Mallardi ..... C09D 133/08 |
| 2019/0292789 | A1 | 9/2019 | Mallick et al. |

FOREIGN PATENT DOCUMENTS

| | | | |
|---|---|---|---|
| EP | 0420540 | B1 | 8/1996 |
| EP | 0799648 | A1 | 10/1997 |
| EP | 2871053 | A1 | 5/2015 |
| GB | 2441054 | A | 2/2008 |
| GB | 2473681 | A | 3/2011 |
| GB | 2498138 | A | 7/2013 |
| JP | 2001 207598 | A | 8/2001 |
| JP | 2004-251102 | A | 9/2004 |
| WO | WO2012/162845 | A1 | 12/2012 |
| WO | WO2017/091490 | A1 | 6/2017 |
| WO | WO2018/154427 | A1 | 8/2018 |

OTHER PUBLICATIONS

Atlas Roofing (NPL: Underlayment Weights and Measurements ([Datasheet [online]. [retrieved on Feb. 5, 2019]. Retrieved from the Internet: <URL: https://www.atlasroofing.com/asphalt-life/underlayment-weights-and-measurements-not-created-equal> (Year: 2019).*

International Search Report and the Written Opinion of the International Searching Authority for PCT/US2021/018360, mailed May 4, 2021.

Extended European Search Report regarding related European Application 21757817.8 dated Jun. 7, 2023.

Fibre Glast; What are Prepregs?; http://www.fibreglast.com/product/about-prepregs/Learning_Center; Available as of Nov. 15, 2019; pp. 1-9.

Youtube: "How to Install TPO/PVC Coating I GAF Roof Mate"; https://www.youtube.com/watch?v=utrSOcyr-ol; dated Mar. 20, 2019.

* cited by examiner

MATRIX ASSISTED TWO COMPONENT ROOF COATING SYSTEM AND METHOD

REFERENCE TO RELATED APPLICATION

The present Patent application claims the benefit of U.S. Provisional Application No. 62/978,032, filed Feb. 18, 2020.

INCORPORATION BY REFERENCE

The disclosures made in U.S. Provisional Application No. 62/978,032, filed Feb. 18, 2020, are specifically incorporated by reference herein as if set forth in their entirety.

TECHNICAL FIELD

This disclosure relates generally to roofing systems and more particularly to two component roof coatings and methods of applying them to a roof.

BACKGROUND

Roof coatings initially applied as two mixed liquid components that react or cure to form a waterproof membrane are known. These coatings rely on one component to modify, activate, deblock, or crosslink the other component, causing a chemical reaction that creates a waterproof membrane on a roof deck. Such coatings are commonly referred to as 2K roof coatings. 2K roof coatings offer superior waterproofing and water shedding properties. However, expensive special equipment such as mixing sprayers generally is required to mix the two components together just before the mixture is sprayed or otherwise applied to a roof. In addition, there is a limited amount of time to apply the material after mixing and before curing, and working times are generally very short after initial application. The application also is labor intensive and requires special skills not possessed by all roofers.

Applying a 2K coating to a roof can be particularly troublesome when applying the coating to a steep slope residential roof. This is at least in part because the liquid mix, when applied, can sag or slump down the slope of a roof before it cures completely. A need exists for a 2K roof coating system and method that successfully addresses these and other shortcomings. It is to the provision of such a system and method that the present disclosure is primarily directed.

SUMMARY

Briefly described, in one aspect, a first component of a two component (2K) roof coating can be applied in advance or on site to a fabric or other substrate material, such as a mesh, foam, web, mat, netting, and/or combinations thereof, into which the first component is substantially saturated or absorbed such that at least a portion of the first component is carried by the fabric. The fabric, or other substrate material, can be attached to a roof deck so that it covers the deck. In some embodiments, the first component can be applied to and soaked or substantially saturated into the fabric prior to installation of the fabric on the deck. In other embodiments, the first component can be applied to the fabric after installation of the fabric on the roof deck. Once the fabric is attached, the second component of the 2K roof coating is sprayed, rolled, or otherwise applied to the fabric carrying the absorbed first component. The two components undergo a chemical reaction and cure into a waterproof membrane coating the roof.

In embodiments, when used on a steep slope residential roof, the fabric acts to substantially reduce or eliminate sagging, slumping, or running of the components down the roof deck during the curing process. No special mixing sprayers or other equipment is required and short working times can be reduced or substantially eliminated. Little specialized skill also may be required, particularly when rolling or brushing the second component onto the fabric.

Thus, a 2K roof coating system and method is disclosed that can substantially eliminate or reduce the need for special equipment and skill for its application, and reduces or substantially eliminates sagging when the coating is applied to a steep slope roof, and is not burdened by short working times.

Some aspects of the present disclosure include, without limitation, a 2K roof coating system comprising a substrate material that is sufficiently porous to absorb or become substantially saturated with, hold, and carry a first component of the 2K roof coating system; and with the substrate being attachable to a roof deck. A second component of the 2K roof coating can be applied to the substrate carrying the first component; and the first and second components reacting to form a waterproof roof coating when the second component is applied to the substrate carrying the first component.

In one embodiment of the 2K roof coating system, the substrate material can comprise a non-woven fabric or other textile material. In another embodiment of the 2K roof coating system, the substrate material can comprise a woven fabric or other textile material. Other substrate materials also can be used, including web materials, netting, grid materials, mesh materials and/or fibrous mats. For example, in an embodiment, the substrate material can comprise a fiberglass mat. The substrate materials further can comprise metal materials, composite, polymer and/or textile materials, and/or combinations thereof.

In some embodiments of the 2K roof coating system, the second component can be sprayed onto the substrate material carrying the first component. In other embodiments of the 2K roof coating system, the second component can be rolled onto the substrate material carrying the first component. In still other embodiments of the two component roof coating system, the second component can be brushed onto the substrate material carrying the first component.

In embodiments of the 2K roof coating system, the first component can comprise a resin, adhesive or other bonding material. In further embodiments, the first component can comprise a hardener or a cross-linking agent. In other embodiments, the first component can comprise one of a resin or a hardener or a cross-linking agent, and the second component can comprise a different one of a resin or a hardener or a cross-linking agent. In still other embodiments, the first component can comprise a binder material applied to and binding the fibers or strands of the substrate material, and which is also is reactive with the second component of the 2K roof coating.

In a further aspect of the present disclosure, methods of applying a 2K roof coating to a roof are provided. In one embodiment, a method can comprise attaching a substrate material to a roof structure or deck; and absorbing a first component of the 2K roof coating into the substrate material. A second component of the 2K roof coating then can be applied to the substrate material carrying the first component; and the first component and the second component will react and cure to form a waterproof roof coating covering thereof.

In one embodiment of the method, the step of applying the substrate material to the roof structure or deck can be performed before the first component of the 2K roof coating is applied to and/or absorbed into the substrate material. In other embodiments, the first component of the 2K roof coating will be applied to and/or substantially saturated into the substrate material before the substrate material is applied to the roof structure or deck. The substrate material further will be adapted or configured to act as a carrier to hold and restrain flowing of the first and second components, to help resist slumping and/or sagging of such components upon application to a roof.

The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWING

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1:
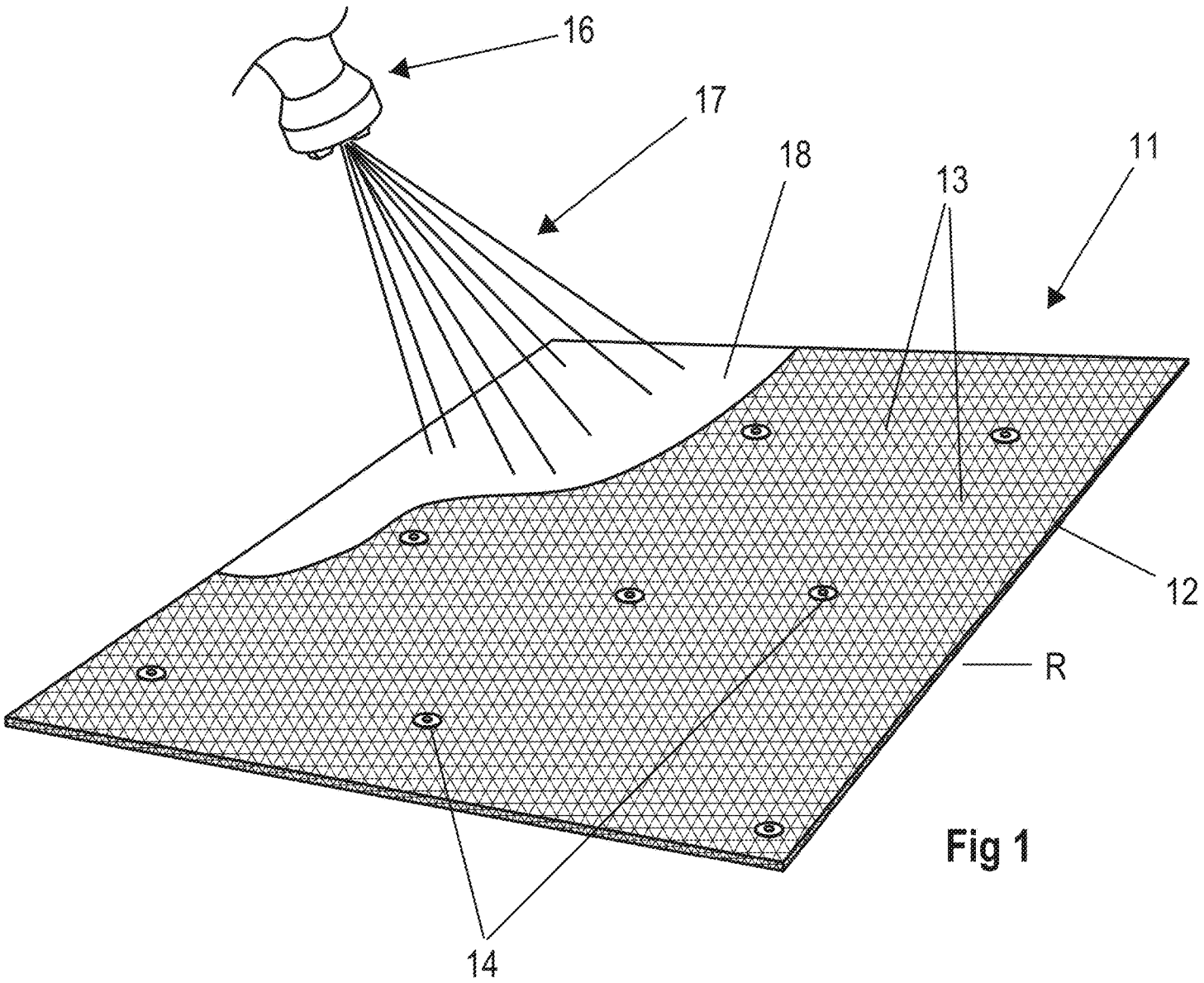
FIG. 1 is a perspective view of an example two component roof coating system and method that embodies principles of the present disclosure.

Various example embodiments of two component (2K) liquid roof coatings and/or 2K roof coating systems are described and shown in the accompanying drawing FIGS. 1-4. The present disclosure further discloses various embodiments of methods of forming a roof with a 2K roof coating, which includes at least one component applied over a substrate material that is mountable along a roof structure or deck and which carries another component of the 2K roof coating. The two components of the 2K roof coating react with one another and cure to form a waterproof membrane or coating along the roof, according to principles of the present disclosure.

The present disclosure will now be discussed in more detail with reference to the drawing figure, wherein reference numerals indicate various aspects of the 2K roof coating system. For example, in FIG. 1, a 2K roof coating system 11 comprises substrate material 10, shown as an including fabric sheet 12 that is attachable to a roof deck or roof structure R with appropriate fasteners 14. A first component of a 2K roof coating system is applied to and will be substantially absorbed or saturated into or carried by and held in place by the fabric 12, as indicated at 13, and thereafter, a second component 15 that is reactive with the first component 13 is applied over the fabric 12, and reacts with the first component, and curing to form a waterproof 2K coating.

The substrate material 10, such as the fabric 12 shown in FIG. 1, also helps establish a relatively uniform thickness of the first component that is substantially the same as the thickness of the fabric. In this way, an appropriate volume of the first component 13 can be substantially automatically metered by the thickness of the fabric 12. In some embodiments, the thickness of the fabric 12 or other substrate material may be from 5 mils to 500 mils, 5 mils to 400 mils, 5 mils to 300 mils, 5 mils to 250 mils, 200 mils, 5 mils to 100 mils, 5 mils to 50 mils, or 5 mils to 25 mils. Other thicknesses also can be used.

In addition, in embodiments, the first component and fabric can combine to form a thickness of 5 mils to 500 mils, 5 mils to 400 mils, 5 mils to 300 mils, 5 mils to 250 mils, 200 mils, 5 mils to 100 mils, 5 mils to 50 mils, 10 mils to 500 mils, 10 mils to 400 mils, 10 mils to 300 mils, 10 mils to 200 mils, 10 mils to 100 mils, 10 mils to 50 mils, 25 mils to 500 mils, 25 mils to 400 mils, 25 mils to 300 mils, 25 mils to 300 mils, 25 mils to 250 mils, 25 mils to 100 mils, 25 mils to 50 mils, 50 mils to 500 mils, 50 mils to 400 mils, 50 mils to 300 mils, 50 mils to 200 mils, 50 mils to 100 mils, and/or other greater or lesser thicknesses.

In this disclosure, a two component or 2K roof coating system may refer to any liquid coating system that requires mixing a first component with a second component at the time of application or mixing on site before application. Such systems may include but are not limited to Epoxies, polyurethanes, polyureas, methacrylates, acrylates, and other similar two component materials. One example of a 2K polyurethane is United Coatings™ Elastuff® 103 roof coating available from GAF of Parsippany, NJ. An example of a 2K silicone is TAP Platinum Silicone brand coatings available from TAP Plastics Corporation of Dublin, California.

The substrate material 10, such as the fabric 12 as illustrated in FIG. 1 additionally can comprise any appropriately resilient fabric that is sufficiently porous or permeable to absorb and hold the first component of a 2K roof coating. For example, and without limitation, the fabric 12 can be made of a woven or non-woven material that can be plastic, fiberglass, or other appropriate material. Examples of appropriate fabrics include, without limitation, GAF United Coatings™ Roof Mate™ brand fabric; Adfors brand W4501, W4503 and W4520; Evalith brand 16/90 fabric; Evalith brand 40/170 fabric; and GAF TigerPaw™ brand underlayment.

In addition, in the present disclosure, it will be understood that the terms "fabric," "substrate material," and/or terms of similar import are not limited solely to fabric materials, but rather refer to and encompass a variety of materials, which can include woven or non-woven fabrics and/or other textile materials, mesh materials, open-cell foams, netting or web materials, mats, and other materials to which a liquid roofing material can adhere or into which at least one or both of the first and second roofing components of the 2K roof coating system will permeate, saturate or soak; or that is at least partially soluble in such 2K liquid roofing components when applied. These terms further can include composite structures containing woven or nonwoven materials, meshes, nets, webs, open cell foams, mats, and other materials; and in some embodiments, also can include aesthetic features printed, woven, or otherwise provided thereon to provide the roof structures formed by the 2K roof coating system and methods of the present disclosure with certain designs, aesthetic appearances, textures, etc.

Figure 2:
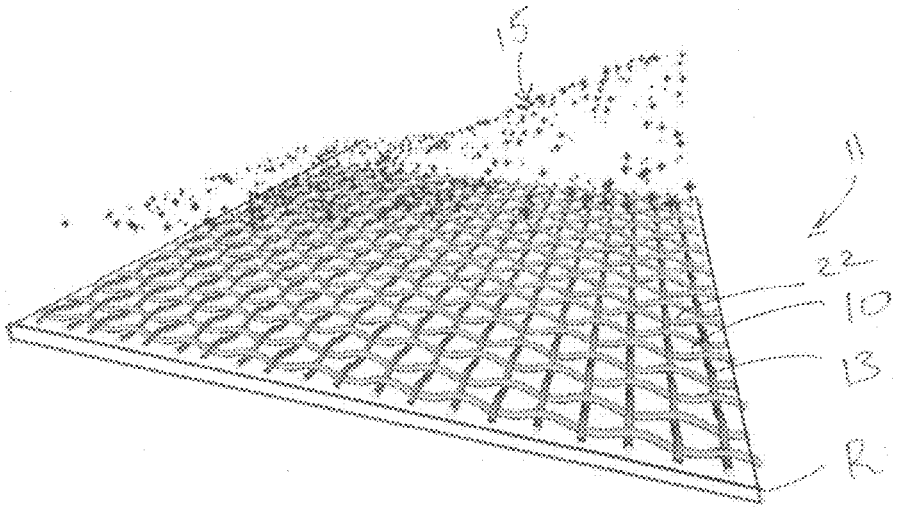
FIG. 2 is a perspective view of another example of a two component roof coating system and method that embodies principles of the present disclosure.

For example, in some embodiments of the 2K roof coating system such as indicated in FIG. 2, the substrate material 10 can include a substantially open weave or porous material, such as a mesh, grid, webbing, or netting type material, that can be formed from metal, plastic, or composite materials. The substrate can be pre-coated or impregnated with the first component of the 2K roof coating, such as a methyl methacrylate (MMA) or similar catalyst material, for example, with the first component applied in a factory setting, or prior to the application of the substrate to the roof deck R, providing an activated substrate for attachment to the roof deck. The substrate further can have mesh or grid openings 22 that can vary in configuration and/or size.

By way of example, the substrate material 10 can include a mesh or grid material with an opening size of 0.01 inches to 10 inches. In other embodiments, the substrate 20 can have opening of other, varying in sizes, such as 0.01 inch to 9 inches, 0.01 inch to 8 inches, 0.01 inch to 7 inches, 0.01 inch to 6 inches, 0.01 inch to 5 inches, 0.01 inch to 4 inches, 0.01 inch to 3 inches, 0.01 inch to 2 inches, 0.01 inch to 1 inch, 0.01 inch to 0.5 inches, 0.01 inch to 0.01 inch, 0.01 inch to 0.05 inch. Other, varying sizes or dimensions of the grid or mesh openings also can be used.

Thereafter, as indicated in FIG. 2, the second component 15 of the 2K roof coating can be sprayed, rolled, or otherwise applied to the substrate 10 with the first component substantially integrated or saturated therewith. The grid or mesh openings 24 of the substrate can capture and hold the second component of the 2K roof coating as it is applied in liquid form, retarding flowing thereof during application and subsequent curing to form the 2K roof coating, such as indicated in FIGS. 3A-4B.

The substrate or fabric materials used for the 2K roof coating systems according to embodiments of the present disclosure generally will be selected and/or configured or adapted to control flowability, sagging, running or slumping of the first and/or second components of the 2K roof coatings during or upon application of one or both components in liquid form to the substrate after the application to the deck or structure of a roof, including applications along a pitched surface of a roof. The resultant 2K roof coating cures to form a waterproof roof membrane or coating with a relatively uniform thickness, forming a substantially monolithic coverage that can achieve longer service life and better weathering ability. In some embodiments, the waterproof roof membrane formed by the cured 2K component roof coating system further can act as a vapor permeable water shedding layer for the structure. In other embodiments, an additional vapor barrier layer also can be applied to the roof structure underlying the 2K component roof system.

Figure 3A:
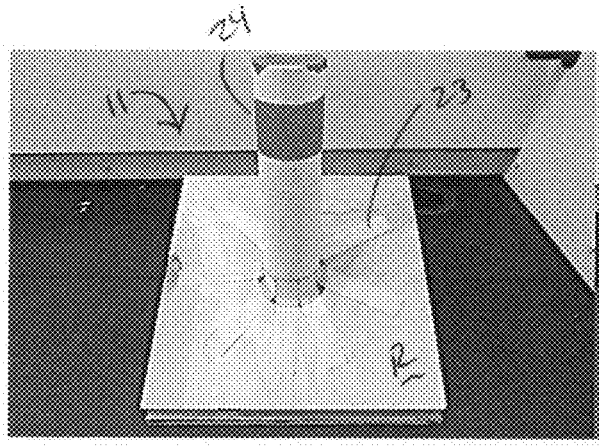
FIGS. 3A-3B illustrate an example application of a first component of the two component roof coating system to a roof deck according to embodiments of the present disclosure.
Figure 3B:
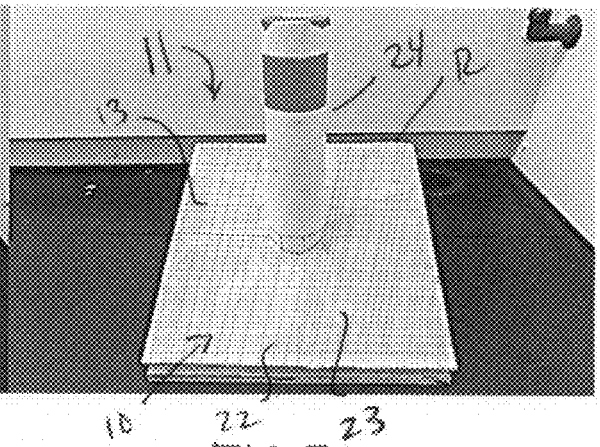

In embodiments, such as shown in FIGS. 1-3B, the substrate material 10 can include a fabric 12, mesh or grid material that may be rolled out onto a roof deck and secured to the deck R with appropriate fasteners 14 (FIG. 1), with staples, or with adhesives, tape, welding or bonding or combinations thereof. For example, FIGS. 3A-3B show applications of a mesh and fabric strips or tape materials 23 applied to a roof deck R and about an obstruction, such as a chimney or a vent pipe 24.

In embodiments, after the fabric 12 (FIG. 1) is secured to the roof deck R, the first liquid component 13 of the 2K roof coating system 11 may be applied to the fabric by spraying, rolling, brushing, or any other appropriate technique. In the process, the first component is substantially absorbed, saturated or permeated into the porous fabric 12. The fabric 12 generally will be sufficiently porous or permeable and resilient to hold and thus carry the first component sufficient to substantially prevent the liquid first component from running down a sloped roof deck. In other words, the fabric will hold the first component in place, substantially preventing sagging or slumping of the first component upon application of the first component thereof.

Further, as mentioned above, the thickness of the fabric also can establish a substantially uniform thickness of the first component on the roof to ensure that an appropriate volume of the first component for mixing and/or reacting with the second component is present. The combination of the two components generally will not result in a total wet film thickness far beyond the thickness of the fabric. It will, however, be understood that, in some instances, the combination of the first component with the fabric can increase the thickness of the fabric.

As further indicated in FIGS. 1-2, the second component 15 will be applied as a liquid roofing material to the fabric 12 carrying the first component 13 of the 2K roof coating system 11 once the fabric 12 has been applied and secured along the deck or other roof structure R. In some embodiments, the liquid second component can be applied along the fabric 12 with an initial wet thickness between 5 and 500 mils in a single pass, and/or further can be applied with a thickness between 3 and 250 mils with a single pass. Other application thicknesses also can be provided. For example, and without limitation, initial wet thicknesses of 5-400 mils, 5-300 mils, 5-200 mils, 5-100 mils, 5-50 mils, 10-500 mils, 200-500 mils, 300-500 mils and/or dry film thicknesses of 3-200 mils, 3-150 mils, 3-100 mils, 3-50 mils, 10-50 mils, 25-250 mils, 50-250 miles, 100-250 mils, 150-250 mils, or 200-250 mils, or 400-500 mils; or other suitable ranges, can be used. In still further embodiments, multiple passes of the second component can be used to build up more thickness if necessary, with each pass having similar thickness ranges.

In addition, in some embodiments, the second component of the 2K roof coating can be applied at various application rates, and may not necessarily add visible thickness to the fabric or substrate material that has been coated with the first component, due to absorption and/or mixing or reaction of the first and second components. For example, the second component of the 2K roof coating can be applied at application rates of 0.1 gallon to 16 gallons per 100 square feet. In other embodiments, the second component can be applied at application rates of 0.1 gallon to 15 gallons per 100 square feet; 0.01 gallon to 14 gallons per 100 square feet; 0.1 gallon to 13 gallons per 100 square feet; 0.1 gallon to 12 gallons per 100 square feet; 0.1 gallon to 11 gallons per 100 square feet; 0.1 gallon to 10 gallons per 100 square feet; 0.1 to 9 gallons per 100 square feet; 0.1 gallon to 8 gallons per 100 square feet; 0.1 gallon to 7 gallons per 100 square feet; 0.1 gallon to 6 gallons per 100 square feet; 0.1 gallon to 5 gallons per 100 square feet; 0.1 gallon to 4 gallons per 100 square feet; 0.1 to 3 gallons per 100 square feet; 0.1 gallon to 2 gallons per 100 square feet; 0.1 to 1 gallon per 100 square feet; 0.1 gallon to 0.5 gallons per 100 square feet. Other application rates also can be used.

As discussed, the substrate material further may be pre-soaked or saturated with a first component of the 2K roof coating system. In embodiments, the substrate material can be saturated or formed with the first component permeated therein at a factory and delivered to the site of the roof installation. In some such embodiments, the substrate material may be subjected to chemical modification by chemically grafting or integrating a catalyst to the fibers of the fabric. For example, the substrate material can compromise a woven or non-woven fabric, fibrous mat, mesh, netting or web material that can be treated with a binder material to help bind the fibers together, and which binder material can include a catalyst or other material that will react with the second component of the 2K component roof coating, forming a substrate material having the first component integrated therewith.

Thus, the delivery of a first complement of the 2K roof coating system can be provided as part of an embedded fabric or substrate, whereby the need for a separate coating or application step in which the substrate material is separately treated with the first component can be by-passed. The pre-soaked or saturated substrate material carrying the first component of the 2K component roof coating can be positioned along the roof deck and attached to the roof deck with fasteners. Once attached, the second component of the 2K component roof coating is applied to the pre-soaked or saturated substrate material. Upon application of the second component, a chemical reaction is initialized between the first and second components of the 2K roof coating, creating a robust and waterproof coating on the roof upon curing.

Alternatively, in other embodiments, the first component of the 2K roof coating can be applied and soaked or substantially saturated into the substrate material at the site of installation of the roof, before or after the substrate material is installed on the deck of the roof. For example, a kit forming a roof with a 2K roof coating can be provided. The kit can include a substrate material that, in some embodiments, can be substantially pre-saturated or permeated with a first component of the 2K roof coating. The first component of the 2K roof coating also can be provided as a separate item of the kit, which also will include a second component of the 2K roof coating. which is reactive with the first component. The substrate material will be applied to the roof deck, and will be saturated with the first component. The second component of the 2K roof coating is then applied. A catalyst within either the first or the second component catalyzes a chemical reaction between the mixed the first and second components, which cures to form a waterproof roof coating along the rood deck.

Example 1

In one embodiment, GAF United Coatings Roof Mate brand fabric was laid down to roof deck with fasteners. A first component comprising a liquid epoxy formulation was then applied to the fabric using a sprayer. The epoxy first component was effectively absorbed into the fabric and held by the fabric in uniform thickness across the area of the fabric. Then, amine second component formulations were successively applied to the epoxy soaked fabric. The amine second components spontaneously mixed with the epoxy first component absorbed into the fabric to initiate a cross-linking reaction. The result was a continuous and monolithic waterproof roof coating.

Example 2

GAF United Roof Mate brand fabric was pre-soaked with a first component comprising a benzoyl peroxide (BPO) solution in acetone and the soaked fabric was air-dried. The dried BPO impregnated fabric was laid on and fastened to a roof deck with fasteners. A second component comprising a methyl methacrylate (MMA) formulation was applied with a sprayer and/or a roller to the pre-soaked and dried fabric. A crosslinking reaction was initiated by the BPO to form a waterproof roof coating of uniform thickness on the roof deck.

Example 3

A fabric, which may be a cotton cloth fabric, was subjected to chemical modification by chemically grafting a platinum catalyst first component to the fibers of the fabric. The modified fabric was attached to a roof substrate with appropriate fasteners. A second component comprising a mixture of polyhydrosiloxane and polyvinylsiloxane was applied with a sprayer (an alternative would be a roller) onto modified fabric. The second component was catalyzed by the platinum moiety and formed a hydrosylation addition cured silicone roof coating.

Figure 4:
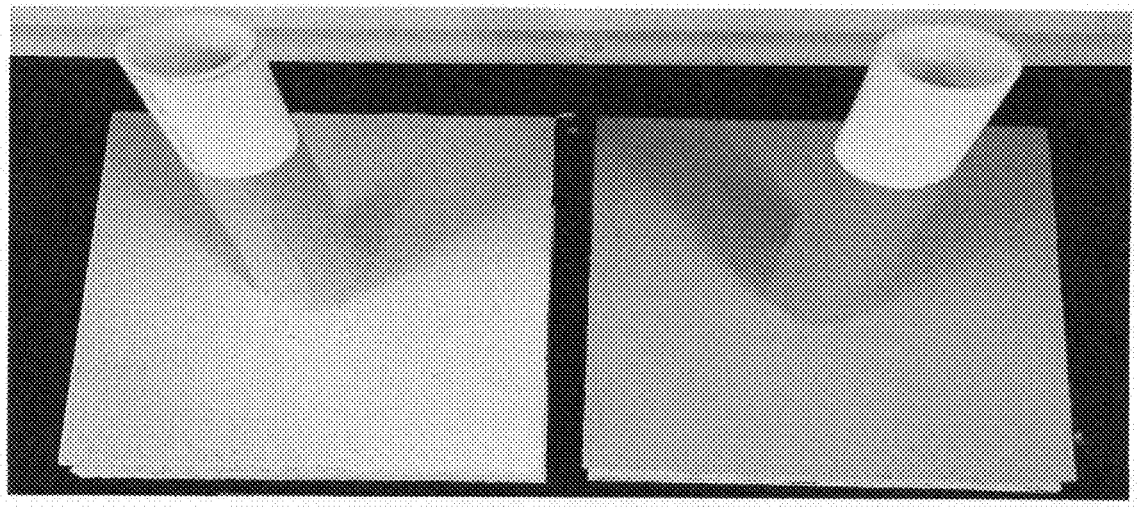
FIG. 4 illustrates a comparison of a model chimney flashed with an embedded substrate cured with an applied second component versus a pre-mixed 2K roof coating.

FIG. 4 illustrates an application of a substrate embedded or substantially impregnated with a catalyst (MMA) for a 2K roof coating system 11 according to the principles of the present disclosure compared to an application of a pre-mixed 2K resin coating. As indicated, the 2K roof coating system 11 provides substantially complete coverage, without requiring the use of special equipment to mix and apply the 2 components of the roof coating.

In the previously discussed non-limiting examples, the fabric not only acts as a carrier for the first component, it held the first component in place and established a uniform thickness of the first component on the roof. When the second component was applied and began to react with the first component, the mixture was prevented by the fabric from sagging or slumping during the curing reaction. The result was a generally uniformly thick waterproof roof coating throughout the area of the fabric.

In the foregoing disclosure, the term "roofing" is used in the present disclosure to simplify the description. It will be understood, however, that this term is meant to encompass any part of a building structure and its additions, peripherals, or attachments, including sloped or pitched roofs that have a slope between 30 degrees and 180 degrees (meaning the back side of the structure). In embodiments, the slope can be between 30 degrees and 80 degrees, 30 degrees and 70 degrees, 30 degrees and 60 degrees, 30 degrees and 50 degrees, 30 degrees and 40 degrees, 30 degrees and 90 degrees, 40 degrees and 90 degrees, 50 degrees and 90 degrees, 60 degrees and 90 degrees, or 70 degrees and 90 degrees. This term also encompasses flat roofs or roofs that include sloped/pitched and flat portions.

Embodiments of the present disclosure further are not limited to commercial or residential structures, and are applicable to a variety of building structures and building components. For example, in addition to roofing structures or systems, various embodiments and features of the systems and methods can be used with walls, such as perpendicular, slanted or slope walls or partitions, permanent and temporary partitions, beams, columns, slabs, etc. or other features or components of commercial, residential, temporary or other building structures. Additionally, the terms "roofing," roof deck," and "roof structure" may include any original or modified material including wood decking, roof membranes, roof panels, asphalts, soil, or pre-existing coatings.

Still further, embodiments of the present disclosure also can be used with other structures or structural components, such as for use with vehicle structures, e.g. motor vehicle structures and components (e.g., vehicle body, chassis, or other structural components of a motor vehicle), aerial vehicle structures and components (e.g., fuselage, wings, airfoil or other structural component of an aerial vehicle), or maritime vehicles and components (e.g., hull, propeller/rotor, or other structural component of a maritime vehicle).

The foregoing description generally illustrates and describes various embodiments of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the disclosure, and numerous variations, modifications, and additions further can be made thereto without departing from the spirit and scope of the present disclosure as set forth in the appended claims.

The invention claimed is:

1. A method comprising:

obtaining a plurality of pre-coated substrate materials;

wherein the substrate materials are pre-coated with a first component of a two component roof coating, such that the substrate materials are permeated with the first component prior to being obtained and carry the first component therewith;

positioning the substrate materials permeated with the first component along a deck of a roof; and after the substrate materials permeated with the first component are positioned along the deck of the roof, applying a second component of the two component roof coating to the substrate materials;

wherein the second component is applied as a liquid;

wherein the second component is reactive with the first component to form a waterproof roof coating, and wherein the substrate materials are configured to restrain flowing of the second component along the deck of the roof.

2. The method of claim 1, wherein the substrate materials comprise a plurality of fibers and a binder material adapted to bind the plurality of fibers of the substrate materials; and further comprising reacting the binder material with the second component of the two component roof coating as the second component is applied.

3. The method of claim 1, further comprising attaching the substrate materials to the deck of the roof with fasteners.

4. The method of claim 1, wherein applying the second component comprises spraying, rolling, brushing or combinations thereof.

5. The method of claim 1, wherein the substrate materials comprise a fabric, mesh, foam, mat, grid material, or combinations thereof, having a plurality of openings configured to at least partially receive the second component therethrough so as to control flowability, sagging, running, slumping, or combinations thereof, of the second component during application of the second component.

6. The method of claim 1, wherein the first component comprises a liquid applied to the substrate materials by soaking, spraying, rolling, brushing or combinations thereof.

7. The method of claim 1, wherein the substrate materials are permeated with the first component by chemically modifying the substrate materials with the first component, the first component comprising a catalyst adapted to initialize a reaction with the second component upon application of the second component.

8. The method of claim 1, wherein applying the second component comprises applying the second component to the substrate materials with a wet thickness of 5 mils to 500 mils.

9. The method of claim 1, wherein positioning the substrate materials along the deck of the roof comprises applying the substrate materials permeated with the first component along a deck of a sloped roof having a slope of at least 30 degrees.

* * * * *